US008863834B2

(12) United States Patent
Buytaert et al.

(10) Patent No.: US 8,863,834 B2
(45) Date of Patent: Oct. 21, 2014

(54) FRICTION REDUCING WEAR BAND AND METHOD OF COUPLING A WEAR BAND TO A TUBULAR

(75) Inventors: Jean Buytaert, Mineral Wells, TX (US); Eugene Edward Miller, Weatherford, TX (US); Ira Eugene Hining, Weatherford, TX (US)

(73) Assignee: Antelope Oil Tool & Mfg. Co., LLC, Mineral Wells, TX (US)

( * ) Notice: Subject to any disclaimer, the term of this patent is extended or adjusted under 35 U.S.C. 154(b) by 450 days.

(21) Appl. No.: 12/755,981

(22) Filed: Apr. 7, 2010

(65) Prior Publication Data

US 2010/0252274 A1 Oct. 7, 2010

Related U.S. Application Data

(60) Provisional application No. 61/287,665, filed on Dec. 17, 2009, provisional application No. 61/237,202, filed on Aug. 26, 2009, provisional application No. 61/221,716, filed on Jun. 30, 2009, provisional application No. 61/167,482, filed on Apr. 7, 2009.

(51) Int. Cl.
*E21B 17/10* (2006.01)

(52) U.S. Cl.
CPC ..... *E21B 17/1085* (2013.01); *E21B 17/1064* (2013.01); *E21B 17/1028* (2013.01)
USPC ..... 166/241.3; 166/241.6; 166/241.1; 166/241.7; 175/325.1; 175/325.5

(58) Field of Classification Search
USPC ..... 166/380, 241.1, 241.6, 241.7, 241.3; 175/325.6, 324.5, 325.1, 325.5
See application file for complete search history.

(56) References Cited

U.S. PATENT DOCUMENTS 1,201,706 A 10/1916 Dodge
2,368,401 A 1/1945 Baker (Continued)

FOREIGN PATENT DOCUMENTS

WO WO9510685 A2 4/1995
WO WO0159249 A2 8/2001

OTHER PUBLICATIONS

PCT/US2010/030310, "PCT Invitation to Pay Additional Fees", Oct. 21, 2010, 5 pages.

(Continued)

*Primary Examiner* — David Bagnell
*Assistant Examiner* — Taras P Bemko
(74) *Attorney, Agent, or Firm* — MH2 Technology Law Group, LLP

(57) ABSTRACT

In one embodiment, a wear band comprises a rotating element having a bore receivable on a tubular, the bore comprising first and second bore portions slidably receiving first and second sleeve bearings. Outer surfaces of the sleeve bearings slidably engage the bore portions and the bores of the sleeve bearings slidably engage the tubular. A first stop collar and a second stop collar may be received on the tubular to together straddle the rotating element and sleeve bearings to longitudinally secure the rotating element in a position on the tubular. The tubular may be included within a tubular string run into a borehole or into the bore of an installed casing, such as in casing while drilling. The rotating element provides stand-off between a tubular and the wall of a bore, reduces frictional resistance to longitudinal sliding and also to rotation of the tubular string within the bore.

14 Claims, 17 Drawing Sheets

(56) References Cited

U.S. PATENT DOCUMENTS

| | | | | |
|---|---|---|---|---|
| 2,496,402 | A | 2/1950 | McVeigh et al. | |
| 2,797,756 | A | 7/1957 | Hall, Sr. | |
| 2,824,613 | A | 2/1958 | Baker et al. | |
| 2,855,052 | A | 10/1958 | Wright et al. | |
| 2,962,313 | A | 11/1960 | Conrad | |
| 3,292,708 | A | 12/1966 | Mundt | |
| 3,563,575 | A | 2/1971 | Sanford | |
| 3,652,138 | A | 3/1972 | Collett | |
| 3,916,998 | A * | 11/1975 | Bass et al. | 166/301 |
| 4,363,360 | A | 12/1982 | Richey | |
| 5,501,281 | A | 3/1996 | White et al. | |
| 5,692,562 | A | 12/1997 | Squires | |
| 5,706,894 | A | 1/1998 | Hawkins, III | |
| 5,860,760 | A | 1/1999 | Kirk | |
| 5,908,072 | A | 6/1999 | Hawkins | |
| 6,679,335 | B2 | 1/2004 | Slack et al. | |
| 7,159,619 | B2 | 1/2007 | Latiolais, Jr. et al. | |
| 2003/0150611 | A1 * | 8/2003 | Buytaert | 166/241.6 |

OTHER PUBLICATIONS

Frank's Anaconda Stop Collar Sheet, Frank's Casing Crew & Rental Tools, Inc., Lafayette, LA, 2003.

* cited by examiner

FRICTION REDUCING WEAR BAND AND METHOD OF COUPLING A WEAR BAND TO A TUBULAR

STATEMENT OF RELATED APPLICATIONS

This application depends from and claims priority to U.S. Provisional Application Ser. No. 61/287,665 filed on Dec. 17, 2009, U.S. Provisional Application No. 61/237,202 filed on Aug. 26, 2009, U.S. Provisional Application No. 61/221,716 filed on Jun. 30, 2009, and U.S. Provisional Application No. 61/167,482 filed on Apr. 7, 2009.

BACKGROUND OF THE INVENTION

1. Field of the Invention

This application relates to drilling and casing of earthen boreholes. Specifically, this application relates to a wear band for a tubular and a method of coupling a wear band to a tubular to be run into an earthen borehole. More specifically, this application relates to a friction-reducing wear band.

2. Brief Description of the Related Art

Earthen boreholes may be drilled using a tubular string, e.g., a drill string, to rotate a drill bit against the end of a borehole to remove material and extend the borehole. A drill string includes threadably connected segments of drill pipe that are typically rotated and longitudinally advance the drill bit into the earth's crust. Other drill strings may be coupled to a mud motor powered by pressurized fluid to rotate the drill bit as the drill string slides longitudinally along the borehole.

After a targeted depth is achieved, typically the drill string is removed from the borehole and a second type of tubular string called casing is made-up and run into the borehole to a targeted interval where it is cemented in place to stabilize the borehole. After a section of a borehole is cemented with casing, continued drilling through the bore of the cemented casing may further extend the borehole, and subsequent casing strings may be installed through the cemented sections of casing and cemented within the extended portion of the borehole to further stabilize and extend the borehole in a step-wise manner.

In extended reach boreholes and boreholes having horizontal or highly deviated sections, the frictional resistance to both rotational and longitudinal movement of a tubular is substantially greater because the weight of the tubular bears more directly on the floor (e.g., downwardly disposed side) of the borehole. There is a potential for damage or erosion of the outer surface of the tubular where the tubular is moved within the bore of an installed casing string when there is direct metal-to-metal contact.

Advances in drilling technology enable some boreholes to be drilled and cased using a single tubular that serves as both the drill string and the casing string. In this process, known as "casing while drilling," a tubular may be used to rotate a drill bit to extend the borehole, and the tubular is then cemented into place within the borehole. Casing while drilling eliminates the need to trip drill pipe into and out of the borehole to service the drill bit or to clear the borehole for installation of a casing string. When the borehole is drilled to its targeted subsurface objective, the drill bit at the end of the casing string may either be milled out or collapsed to permit retrieval to the surface through the bore of the casing string. Casing while drilling may provide a significant cost savings from reduced drilling time and by eliminating the need to provide and maintain a drill string on a rig, and it may also reduce the risk of borehole collapse. However, casing is generally larger than drill pipe, thereby resulting in more frictional contact with the borehole, and the need to rotate the casing within the borehole may exacerbate wear.

Wear bands have been proposed to protect tubular strings from excessive wear. One such wear band, disclosed in U.S. Pat. No. 7,124,825 to Slack, is installed on a tubular by radial deformation of both a wear band sleeve and the adjacent wall of the tubular to crimp and secure the wear band on the tubular.

Another wear band solution, disclosed by Male et al.'s U.S. Pat. No. 7,412,761, provides a mold coupled to a tubular and filled with a composite material that hardens or cures to form a wear band.

A similar wear pad disclosed in Calderoni et al.'s U.S. Pat. No. 7,195,730 uses plastic compounds injected into molds that, upon curing or hardening, form strips or pads that adhere to the exterior wall of the tubular.

A centralizer disclosed in Clark et al.'s U.S. Publication 20080210419 provides one or more friction-reducing sliders disposed within one or more annular recesses or grooves machined within a bore through the centralizer to reduce rotational torque transmitted between the centralizer and a tubular received through the bore. A shortcoming of Clark et al.'s centralizer is that the body appears to slide along the tubular until it, and not a friction-reducing slider, engages an external feature on the tubular exterior, such as a sleeve-type tubular connection, another centralizer or a stop collar, resulting in unwanted friction between the rotating centralizer and that external feature.

What is needed is a wear band to reduce wear on a tubular that can be installed in the field, for example, at a pipe rack or a pipe yard, in almost any climate and without the need for large machines or skilled operators. What is needed is a wear band that does not require large, expensive sections of tubular to be threadably coupled intermediate adjacent sections of the tubular, and a wear band that can be coupled to a conventional tubular as opposed to being disposed on a special tubular section that must be included within the tubular string. What is needed is a wear band without small rolling elements (e.g., spherical bearings) that are subjected to an extremely large number of cycles or that are incompatible with uneven or rough rolling surfaces. What is needed is a wear band that reduces frictional resistance to both longitudinal and rotational movement of a tubular within a borehole or within the bore of a casing.

SUMMARY

Embodiments of the wear band and method of coupling a wear band to a tubular satisfy the above-stated needs. In one embodiment of the wear band, the bore of a rotating element is received onto a tubular having a non-upset end connection over which the wear band may be installed. The wear band comprises a rotating element having a bore and an exterior wear surface comprised of a friction reducing material such as, for example, but not limited to, hardened steel, nylon, plastic, composite or brass, to reduce frictional resistance to longitudinal sliding movement of the tubular through a bore, which may be, for purposes of the claims that follow, an earthen borehole or the bore of an installed section of casing. The bore of the rotating element may receive sleeve bearings radially intermediate the bore of the rotating element and the tubular to reduce frictional resistance to rotation of the rotating element on the tubular and, thus, to reduce the torque demand for rotation of a tubular string that includes the tubular within a borehole or within a bore of a casing.

In one embodiment of the method of installing a wear band, the wear band may be rotatably secured to a tubular intermediate a first stop collar and a second stop collar that straddle the sleeve bearings and the rotating element to limit or prevent longitudinal movement of the sleeve bearings and the rotating element. In one embodiment, the sleeve bearings may be rotatable within, but longitudinally coupled to, the rotating element to prevent longitudinal movement of the sleeve bearings relative to the rotating element. This embodiment may be used to prevent the rotating element from frictional contact with the tubular and/or the first and second stop collars, e.g., to isolate all sliding contact to the sleeve bearings. In another embodiment, the rotating element may be connected to the sleeve bearings using, for example, a connector, an adhesive or an interference fit.

Another embodiment of the wear band provides a rotating element having a bore comprising a bore first portion and a bore second portion separated one from the other by a shoulder. For example, the bore of the rotating element may comprise a bore first portion and a bore second portion separated one from the other by a radially inwardly protruding barrier, such as a protruding wall, within the bore of the rotating element. In this embodiment, a first sleeve bearing may be disposed radially intermediate the bore first portion and the tubular, and a second sleeve bearing may be disposed radially intermediate the bore second portion and the tubular, to contact the tubular and the rotating element and to together reduce frictional resistance to rotation of the rotating element on the tubular. In one embodiment, this configuration provides a rotating element that is maintained in its longitudinal position by engagement of the shoulder with the first and second sleeve bearings. This configuration prevents frictional engagement between the rotating element and the tubular or stop collars.

In one embodiment, the bore first portion of the rotating element may receive the first sleeve bearing and at least a portion of a sleeve-shaped bearing spacer extending along the tubular from the first stop collar, and the bore second portion of the rotating element may receive the second sleeve bearing and at least a portion of a sleeve-shaped bearing spacer extending from the second stop collar along the tubular. The bearing spacers together straddle the first and second sleeve bearings to limit the range of movement of the rotating element on the tubular. The first and second bearing spacers may, in one embodiment, be of an outer diameter sized to fit within the bore first portion and the bore second portion to generally isolate the bores from exposure to borehole fluids and debris. Structures that may comprise one or more of the friction reducing materials include, but are not limited to, the bore and/or bore portions of the rotating element, the bearings spacers and the sleeve bearings.

In one embodiment, at least one of the sleeve bearings provided to reduce friction to rotation of the rotating element comprises friction reducing material such as, but not limited to, polytetrafluoroethylene ("PTFE"), TetraFluorEthylene-Perfluorpropylene ("FEP") and PerFluoroAlkoxy ("PFA"). In other embodiments, at least one of the sleeve bearings comprises a friction-reducing material such as, but not limited to, brass or nylon. In another embodiment, at least one of the sleeve bearings comprises a substrate treated, coated, impregnated or encapsulated within a friction reducing material.

In other embodiments, the wear band may be rotatably secured in a position on an exterior of a tubular using a stop collar having a retainer portion received in an interior groove in the bore of a rotating element, a set of slender fingers extending from the retainer portion along the exterior of the tubular, and a sleeve to capture the fingers intermediate the sleeve and the tubular. In one embodiment, the stop collar may further comprise a second set of slender fingers extending from the retainer portion of the stop collar in a direction opposition the direction of extension of the first set of fingers, and a second sleeve to capture the fingers intermediate the sleeve and the tubular. In another embodiment, a second stop collar also having a retainer portion received in either the same or a separate interior groove in the bore of the rotating element, a set of slender fingers extending from the retainer portion and along the exterior of the tubular, in a direction away from the first stop collar, and a second sleeve to capture the fingers intermediate the sleeve and the tubular to further secure the rotating element in the position on the tubular.

In rotatable embodiments of the wear band having a rotating element with an interior groove to receive a retainer portion(s) of a stop collar(s), the rotating element may be rotatably coupled to the stop collar by a variety of methods. For example, in one embodiment, the stop collar comprises a bore with a longitudinal gap, a wall thickness and material that provides sufficient elasticity to allow resilient collapse of the retainer portion for insertion within the bore of the rotating element. The retainer portion of the stop collar is radially aligned with, and allowed to expand into, the interior groove in the bore of the rotating element. The coupled stop collar and rotating element may then be received onto the tubular, moved to the desired installation position and sleeve(s) may be installed on the exposed fingers to secure the wear band on the tubular. Alternately, the rotating element may comprise two or more portions that can be connected to capture the retainer portion of the stop collar within the interior groove of the rotating element. Fasteners, such as screws, bolts and nuts, or pins, adhesives, such as an epoxy, or some interlocking structure, such as a dovetail joint, may be used to connect one portion of the rotating element with the other portion(s) to capture the retainer portion there within. For example, the rotating element may be sectioned into two portions along a plane perpendicular to the axis of the bore of the assembled rotating element, or the rotating element may be sectioned into two portions along a plane that intersects the axis of the bore of the rotating element. Once the rotating element and the stop collar are moved to the desired installation position on the tubular, sleeve(s) may be installed on the exposed fingers to secure the wear band on the tubular.

In another embodiment, a non-rotating wear band with at least one set of fingers extending from the wear band in a first direction is securable in a position on a tubular by receiving a sleeve onto the fingers to capture the fingers intermediate the sleeve and the tubular. In this non-rotating embodiment, the retainer portion of the stop collar is itself the wear member.

The rotating element may comprises an outer coating, shell, pads or other features that may be coupled to an inner body, and the outer coating, shell, pads or other features may be of a hardened or erosion resistant material to impart durability to the wear band.

Embodiments of the wear band may be positioned at uniform intervals along a tubular string, and two or more wear bands may be positioned on a single tubular segment.

The foregoing and other features and aspects of embodiments of the invention will be best understood with reference to the following detailed description of one or more specific embodiments, when read in conjunction with the accompanying drawings, wherein:

DETAILED DESCRIPTION OF EMBODIMENTS

Figure 1:
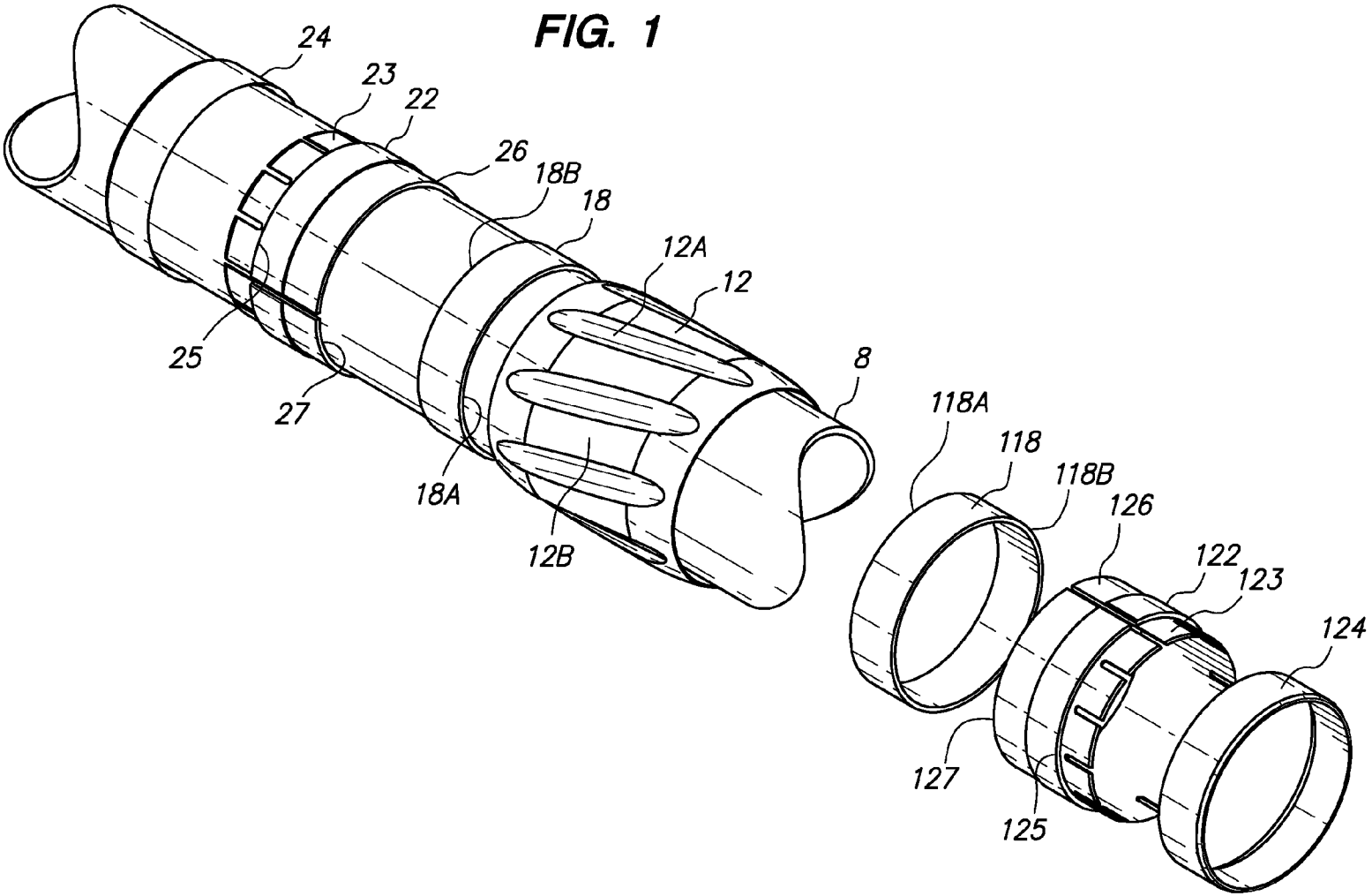
FIG. 1 is an exploded perspective view of one embodiment of a wear band and a tubular on which the wear band is being assembled.

FIG. 1 is an exploded perspective view of an embodiment of a wear band and a tubular on which the wear band may be assembled. The components of the wear band of FIG. 1 are arranged aligned with or received on a tubular 8 in a sequence that facilitates assembly of the components into the wear band discussed below.

The embodiment of the wear band of FIG. 1 includes a rotating element 12 (e.g., sleeve) having a plurality of optional fluid channels 12A in the radially outwardly disposed wear surface 12B, a first sleeve bearing 18 and a second sleeve bearing 118, a first stop collar 22, having a plurality of fingers 23 extending in a first direction, and a second stop collar 122, having a plurality of fingers 123 extending in a second direction opposite the first direction. The depicted first stop collar 22 further includes a first sleeve 24, a stop wall 25 and a bearing spacer 26 extending in the second direction and terminating at a bearing face 27, and the depicted second stop collar 122 further includes a second sleeve 124, a stop wall 125 and a bearing spacer 126 extending in the first direction and terminating at a bearing face 127.

Figure 1A:
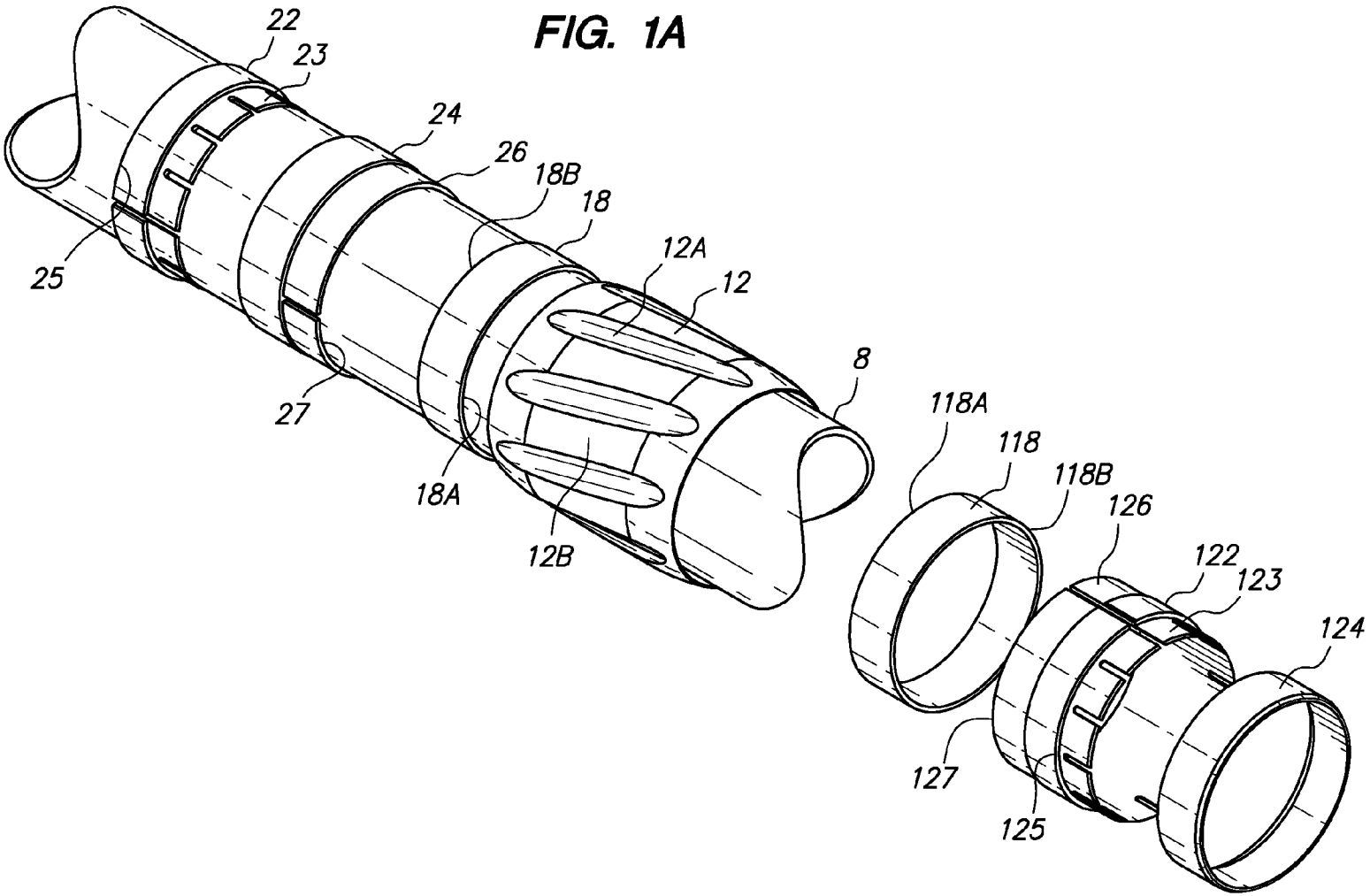
FIG. 1A is an exploded perspective view of an alternate embodiment of a wear band and a tubular on which the wear band is being assembled.

FIG. 1A is an exploded perspective view of an alternate embodiment of a wear band and a tubular on which the wear band is being assembled. Again, the components of the wear band of FIG. 1A are arranged aligned with or received on a tubular 8 in a sequence that facilitates assembly of the components into the wear band discussed below. FIG. 1 (and in subsequent FIGS. 4-7 and 9-12) illustrates embodiments of a stop collar 22 with fingers 23 extending in a direction away from the rotating element 12 to be rotatably secured on a tubular 8 by securing the stop collar 22 to the tubular 8 using a sleeve 24 received on the fingers 23 in an interference-fit. In an alternate embodiment illustrated in FIG. 1A, it is within the scope of the claims that follow to position at least one such stop collar 22 on the tubular 8 with the fingers 23 extending in a direction toward the rotating element 12, and receiving a sleeve 24 on the fingers 23 in an interference-fit. It is also within the scope of the claims that follow to provide a bearing spacer 26 and/or bearing face 27 on the sleeve 24 instead of on the stop collar 22.

Figure 2:
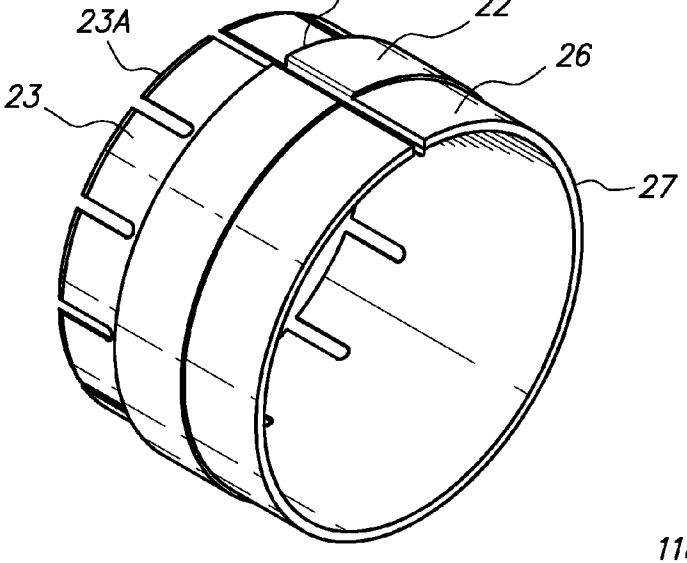
FIG. 2 is an enlarged perspective view of a stop collar component of the embodiment of the wear band of FIG. 1.

FIG. 2 is an enlarged perspective view of the first stop collar 22 of FIG. 1 removed from the tubular 8 (not shown in FIG. 2) for improved illustration. The first stop collar 22 and the second stop collar 122 (see FIG. 1) may, in some embodiments, be substantially identical in structure. FIG. 2 illustrates the first stop collar 22 as including the fingers 23, each having an exterior bevel 23A at the end to assist in guiding the sleeve 24 (not shown in FIG. 2—see FIG. 1) onto the fingers 23 to capture the fingers 23 intermediate the bore of the sleeve 24 and the tubular 8 (not shown in FIG. 2—see FIG. 1). FIG. 2 also illustrates the bearing spacer 26 extending from the stop collar 22 to a bearing face 27 to engage a sleeve bearing.

Figure 3:
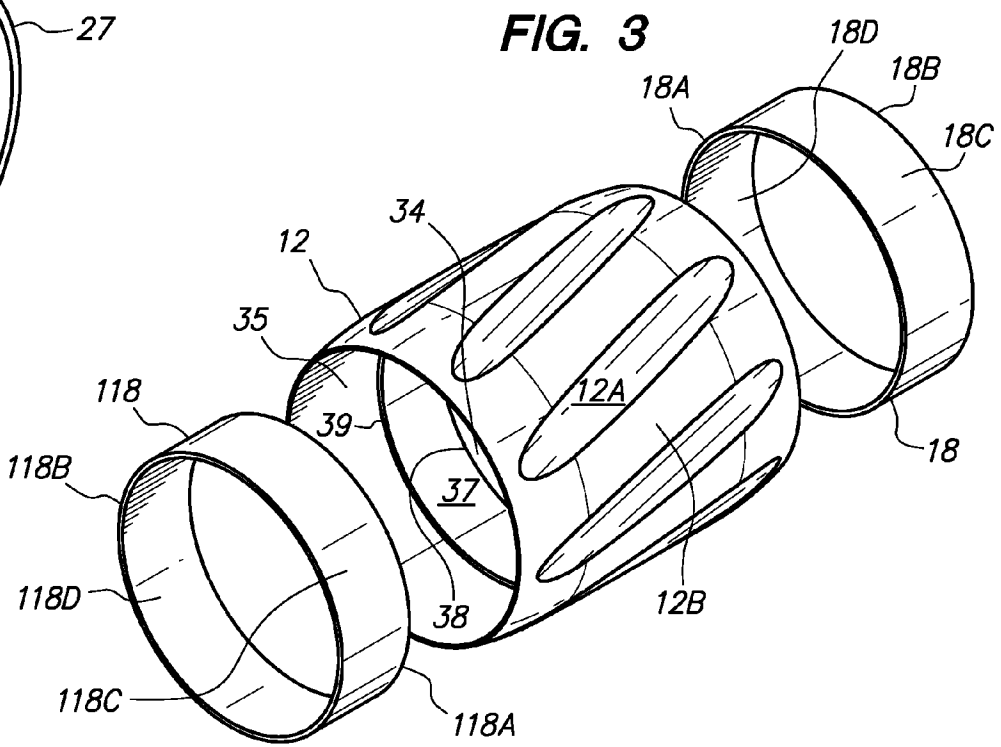
FIG. 3 is a perspective view of the rotating element and the first and second sleeve bearings of the embodiment of the wear band of FIG. 1.

FIG. 3 is a perspective view of the rotating element 12 and the first and second sleeve bearings 18 and 118 of the wear band illustrated in FIG. 1. The rotating element 12 is rotated from its position in FIG. 1 and the tubular 8 (not shown in FIG. 3) and the sleeve bearings 18 and 118 are removed from the bore of the rotating element 12 to reveal a radially inwardly disposed shoulder 37 separating a bore first portion 34 adjacent a first bearing face 38 and a bore second portion 35 adjacent a second bearing face 39 that is on the opposite side of the rotating element 12 (e.g., the shoulder 37 thereof) from the first bearing face 38. In the assembled wear band (to be discussed later in relation to FIG. 4), the first bearing face 38 and second bearing face 39 of the (e.g., radially inwardly) disposed shoulder 37 slidably engage inward end 18A of the first sleeve bearing 18 and inward end 118A of the second sleeve bearing 118, respectively, when the first and second sleeve bearings 18 and 118 are received within the bore first portion 35 and the bore second portion 34, respectively, of the rotating element 12. The outward bearing faces 18B and 118B are directed outwardly to engage, upon assembly, e.g., as shown in FIG. 1, the bearing face 27 on the bearing spacer 26 extending from the first stop collar 22 and the bearing face 127 on the bearing spacer 126 extending from the second stop collar 122, respectively. Upon assembly, and further upon rotation of the rotating element 12 relative to a tubular 8 (e.g., within a borehole or within the bore of an installed casing) the outer surfaces 18C and 118C of the first and second sleeve bearings 18 and 118 will slide against the first bore portion 34 and the second bore portion 35 (see FIG. 3), respectively, and the inner surfaces 18D and 118D of the first and second sleeve bearings 18 and 118 (see FIG. 3) will slide against the tubular 8 (not shown in FIG. 3—see FIGS. 1 and 4).

Figure 4:
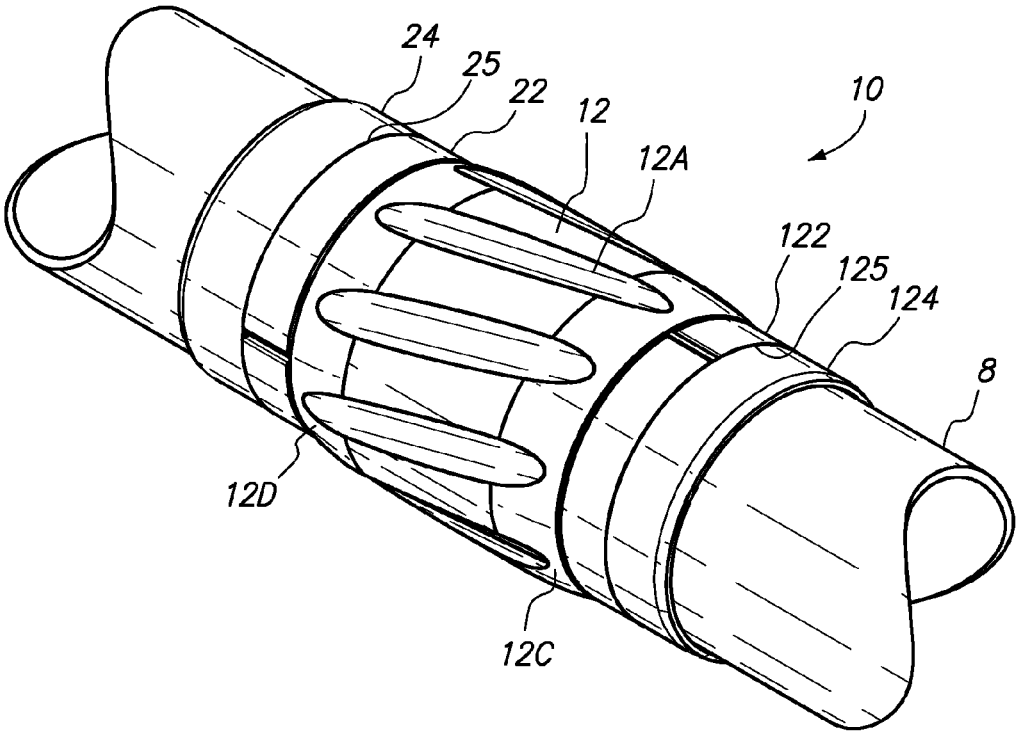
FIG. 4 is a perspective view of the wear band of FIG. 1 after assembly on the tubular.

FIG. 4 is a perspective view of the assembled wear band 10 of FIG. 1, e.g., after installation on the tubular 8 as may be done prior to the tubular 8 being made-up into a tubular string and run into a borehole or a bore of an installed casing, e.g., to turn a drill bit coupled to the end of the tubular string to extend a borehole. The assembly of FIG. 4 may be used, for example, in casing while drilling applications. The rotating element 12 is illustrated in FIG. 4 as received onto the tubular 8 and secured in its position on the tubular 8 by a first stop collar 22 and second stop collar 122 together straddling the sleeve bearings 18 and 118 (not shown in FIG. 4—see FIGS. 1 and 3). At least a portion of the bearing spacers 26 and 126 (not shown in FIG. 4—see FIGS. 1 and 2) of the first stop collar 22 and the second stop collar 122 are received into the bore first portion 34 (not shown in FIG. 4—see FIG. 3) and the bore second portion 35 (same) of the rotating element 12. In one embodiment, the outward ends of the bore first portion and the bore second portion, within the first end 12C and the second end 12D of the rotating element 12, may be flared radially outwardly to guide the first and/or second sleeve bearings upon assembly. The range of movement of the first and second sleeve bearings 18 and 118 (not shown in FIG. 4—see FIG. 3) received within the bore first portion and bore second portions 34 and 35 (same) and the rotating element 12, if any, may be determined by the separation distance between the bearing spacers 26 and 126 (not shown in FIG. 4—see FIG. 2), the width of the shoulder 37 (same), the length of the first and second bore portions 34 and 35 and the length of the first and second sleeve bearings 18 and 118 (which is, in the embodiment shown, less than the lengths of the first and second bore portions 34 and 35). A range of movement of the rotating element 12 on the tubular 8 may be limited or prevented by purposefully coordinating the dimensions of these components.

Figure 5:
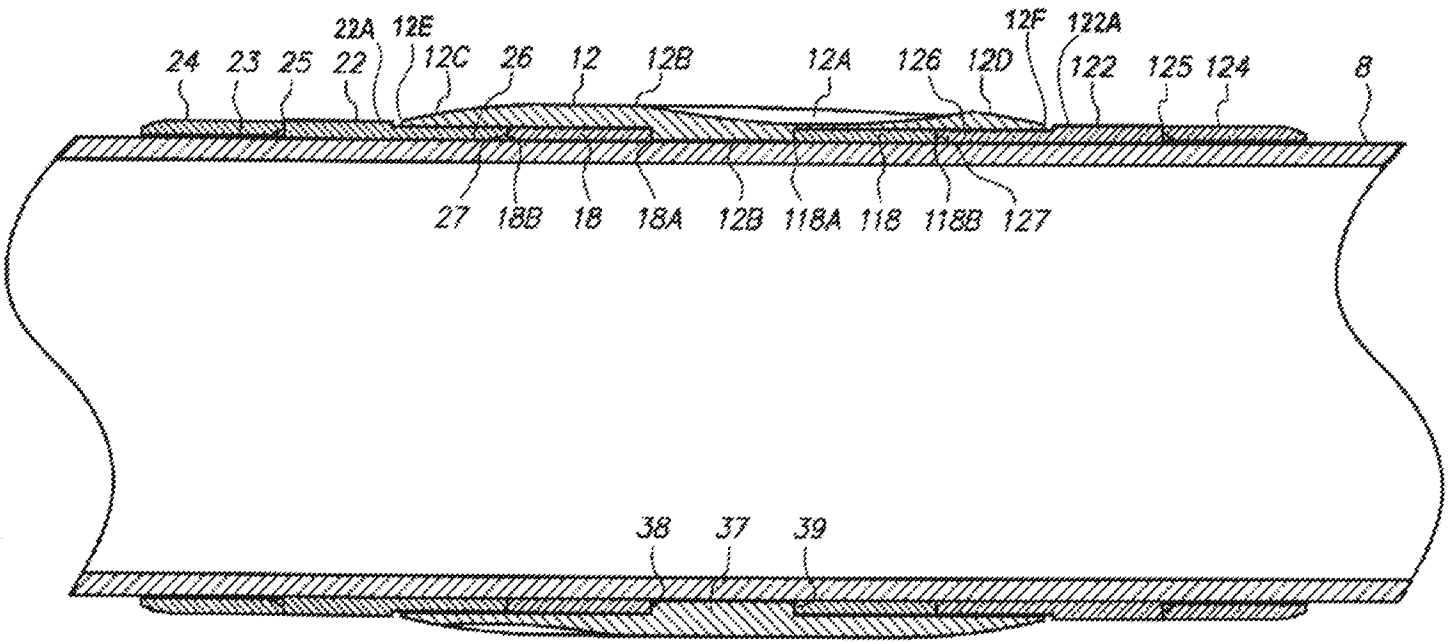
FIG. 5 is an elevation cross-section view of the embodiment of the assembled wear band of FIG. 4.

FIG. 5 is an elevation cross-section view of the wear band of FIG. 4. The rotating element 12 is retained in its position relative to the first and second stop collars 22 and 122 by the interaction between the bearing faces 38 and 39 (of the shoulder 37) with the inward bearing faces 18A and 118A of the first and second sleeve bearings 18 and 118, and also by the interaction between the outward bearing faces 18B and 118B of the first and second sleeve bearings 18 and 118 and the bearing faces 27 and 127 of the bearing spacers 26 and 126 extending from the first and second stop collars 22 and 122. The rotating element 12 may be sized to prevent unwanted frictional resistance to rotation by limiting the radial thickness of the shoulder 37 to less than the thickness of the adjacent sleeve bearings 18 and 118 to prevent unwanted engagement by the shoulder 37 with the tubular 8, and also by preventing the first end 12C and the second end 12D of the rotating element 12 from engaging the stop walls 25 and 125 of the first and second stop collars 22 and 122. The depicted bearing spacers 26 and 126 of the first stop collar 22 and the second stop collar 122, respectively, are depicted as protruding into the bore first portion 34 and bore second portion 35, respectively, and have a radial thickness less than the thickness of the adjacent sleeve bearing 18 and 118. This relative sizing prevents frictional contact between the straddling first and second stop collars 22 and 122 and the rotating element 12, thereby isolating all frictional engagement on the rotating element 12 to the first and second sleeve bearings 18 and 118. Rotating element 12 has an axial first end 12E and an axial second end 12F. Further, interposing the sleeve bearings 18 and 118 between the shoulder 37 of the rotating element 12 and the stop collars 22 and 122, respectively, may prevent the axial first end 12E and the axial second end 12F of the rotating element 12 from engaging exterior shoulders 22A and 122A of the stop collars 22 and 122, respectively.

The rotating element 12 coupled to the tubular 8 facilitates rotation of the tubular 8 relative to the rotating element 12, but also to substantially reduce friction (e.g., axially and rotationally) between the tubular 8 and the wall of a borehole (e.g., bore of a casing) in which the tubular 8 is run. The rotating element 12 is, as seen in the section view of FIG. 5, includes a radially inward taper at the first end 12C and the second end 12D to minimize hanging or catching, and the outer wear surface 12B may comprise a friction-reducing material.

Additional friction reduction may be achieved by polishing, treating, lining, coating, lubricating, impregnating or otherwise conditioning contact surfaces such as, for example, at least one of the first and second bore portions 34 and 35, the exterior surface of the tubular 8, and the outer surface of the rotating element. Such surface conditioning may preferably be directed to the rotating element, e.g., to the first and second bore portions 34 and 35.

In the embodiments of the wear band illustrated in FIGS. 1-5, the sleeve bearings 18 and 118 may be rotatable relative to the rotating element 12 and also rotatable relative to the tubular 8 on which the wear band is installed. This arrangement may decrease the relative rotational speed and the relative number of rotations between two components that are in sliding engagement one with the other. For example, a single rotation of the rotating element 12 on the tubular 8 may cause the sleeve bearings 18 and 118 to revolve once within the first and second bore portions 34 and 35 of the rotating element 12, respectively. Alternately, as another example, a single rotation of the rotating element 12 on the tubular 8 may cause the sleeve bearings 18 and 118 to revolve once relative to the tubular 8 and to remain unrotated relative to the first and second bore portions 34 and 35 of the rotating element 12. Alternately, as another example, a single rotation of the rotating element 12 may cause the sleeve bearings 18 and 118 to revolve only one-half of a revolution within the first and second bore portions 34 and 35, respectively, in addition to revolving only one-half of a revolution on the tubular 8.

FIGS. 1, 2, 4 and 5 merely illustrate one type of stop collar that may be used to install an embodiment of a wear band on tubular, and other stop collars, including stop collars securable using set screws, nuts and bolts, clamps, or epoxy adhesives, may also be used to install embodiments of the wear band on a tubular. It should be understood that any holding device that can provide the needed holding force to prevent longitudinal movement of the wear band along the tubular and that has a positive outer diameter ("POD") that is less than the POD of rotating element can be used to position and hold the wear band illustrated in FIGS. 1-5.

Figure 6:
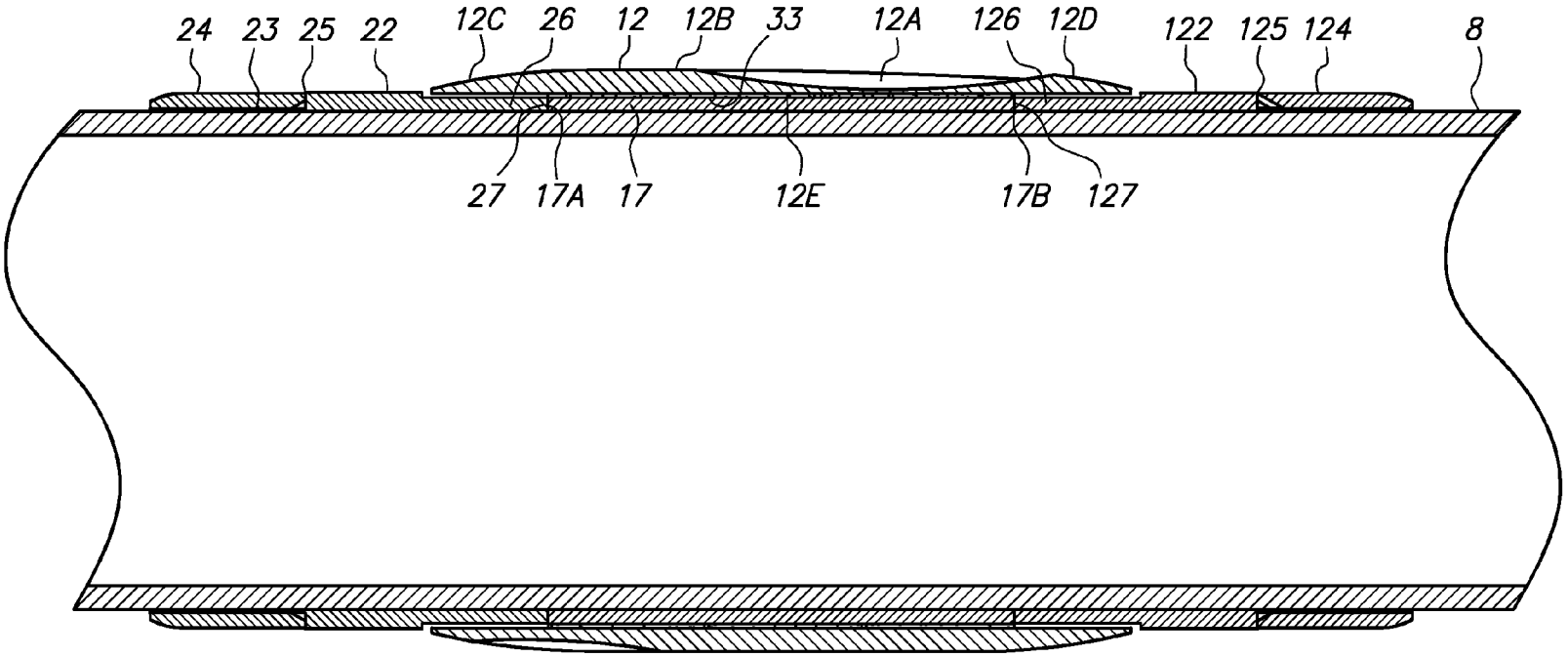
FIG. 6 is an elevation cross-section view of an alternate embodiment of an assembled wear band having a single sleeve bearing secured within the bore of a rotating element.

Other embodiments of the wear band may provide similar advantages. For example, FIG. 6 illustrates an embodiment of the wear band comprising a single sleeve bearing 17 within the bore 33 of the rotating element 12. The sleeve bearing 17 may be connected, e.g., adhesively secured, secured by a connector (e.g., screw, bolt, etc.) and/or received in an interference fit along interface 12E within the bore 33 of the rotating element 12. Alternately, the sleeve bearing 17 may be secured within the bore of the rotating element by alignment of a pre-drilled hole and/or depression with a catch, dog and/or spring operated ball (i.e., a detent). The illustrated sleeve bearing 17 comprises a first end 17A and a second end 17B that cooperate with bearing spacers 26 and 126 extending from straddling stop collars 22 and 122 in the same manner as the embodiment described in connection with FIGS. 1-5.

Figure 7:
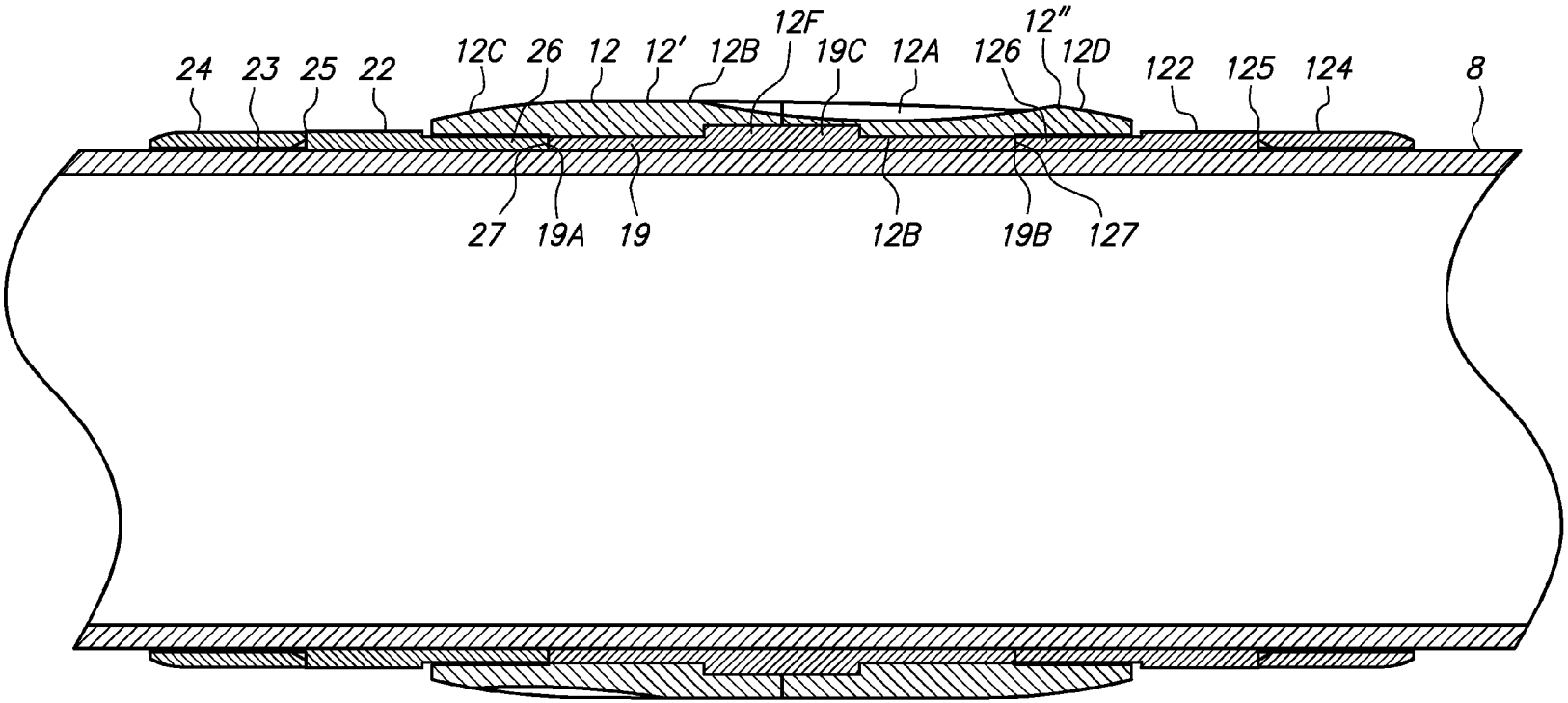
FIG. 7 is an elevation cross-section view of an alternate embodiment of an assembled wear band having a single sleeve bearing with an upset portion engaging the bore of the rotating element.

Another embodiment of the wear band illustrated in FIG. 7 has a single sleeve bearing 19 having a first end 19A, a second end 19B, and an upset portion 19C there between. The upset portion 19C of the sleeve bearing 19 in FIG. 7 is rotatable within an interior groove 12F of the rotating element 12 formed by coupling a rotating sleeve first portion 12' to a rotating sleeve second portion 12" to rotatably couple the rotating element 12 to the sleeve bearing 19. The rotating sleeve first portion 12' to a rotating sleeve second portion 12" may be coupled using an adhesive, using interlocking rotating element portions, fasteners, or some combinations of these. For example, but not by way of limitation, a tubular 8 to be run into a borehole may have an outside diameter of 8.63 inches (21.92 mm) to receive a single sleeve bearing 19 thereon with an inner diameter of 8.64 inches (21.95 mm)(within all of the first end 19A, the second end 19B, and the upset portion 19C therebetween). The single sleeve bearing 19 may have an outer diameter, at the first end 19A and the second end 19B, of 8.85 inches (22.48 mm), and the upset portion 19C therebetween may have an outer diameter of 9.2 inches (23.37 mm) for being received within an interior groove 12F formed by assembly of two or more portions of a rotating element 12 around the single sleeve bearing 19 to rotatably secure the single sleeve bearing 19 within a bore of the assembled rotating element 12.

Figure 8:
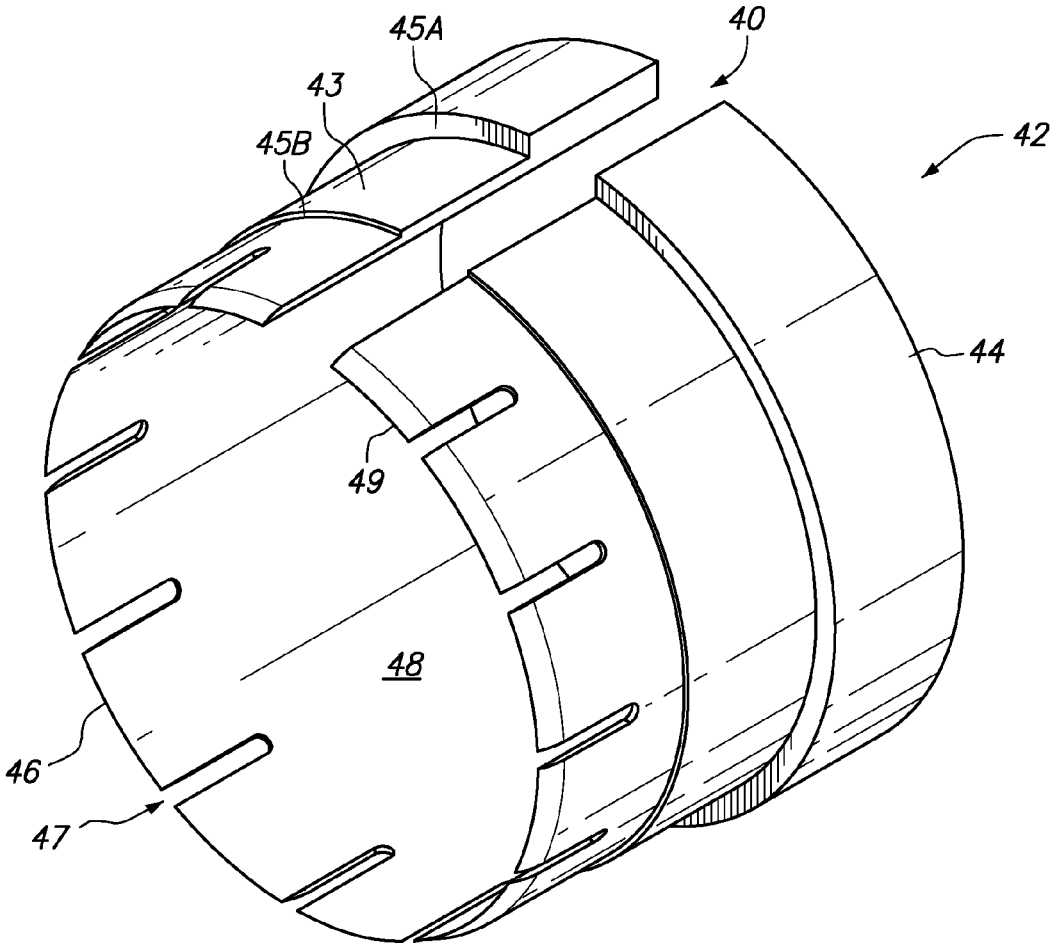
FIG. 8 is an alternative stop collar having a widened gap to accommodate collapse to reduce the outer diameter.
Figure 9:
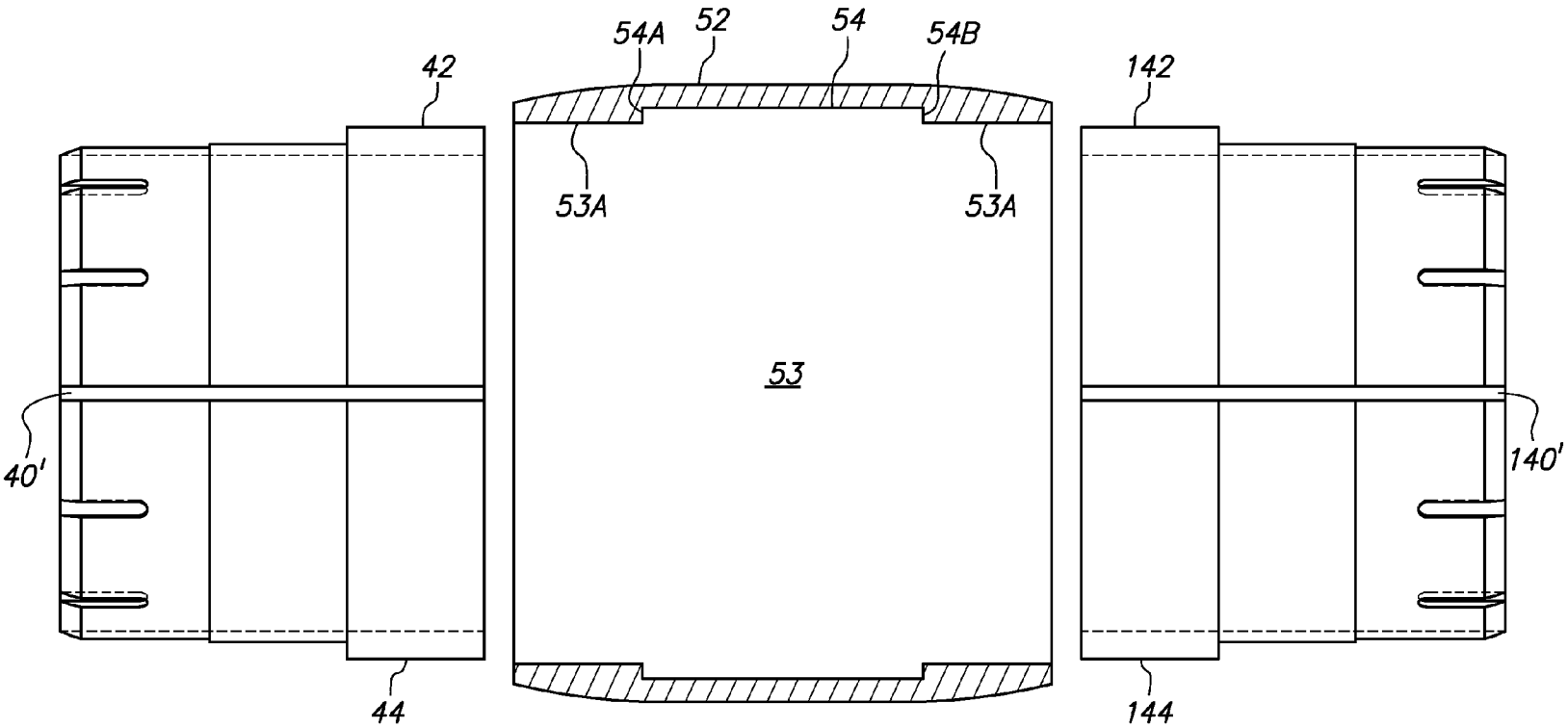
FIG. 9 is an elevation cross-section view of an alternative rotating element with a bore aligned between two stop collars in a collapsed mode to facilitate insertion into the bore of the rotating element.
Figure 10:
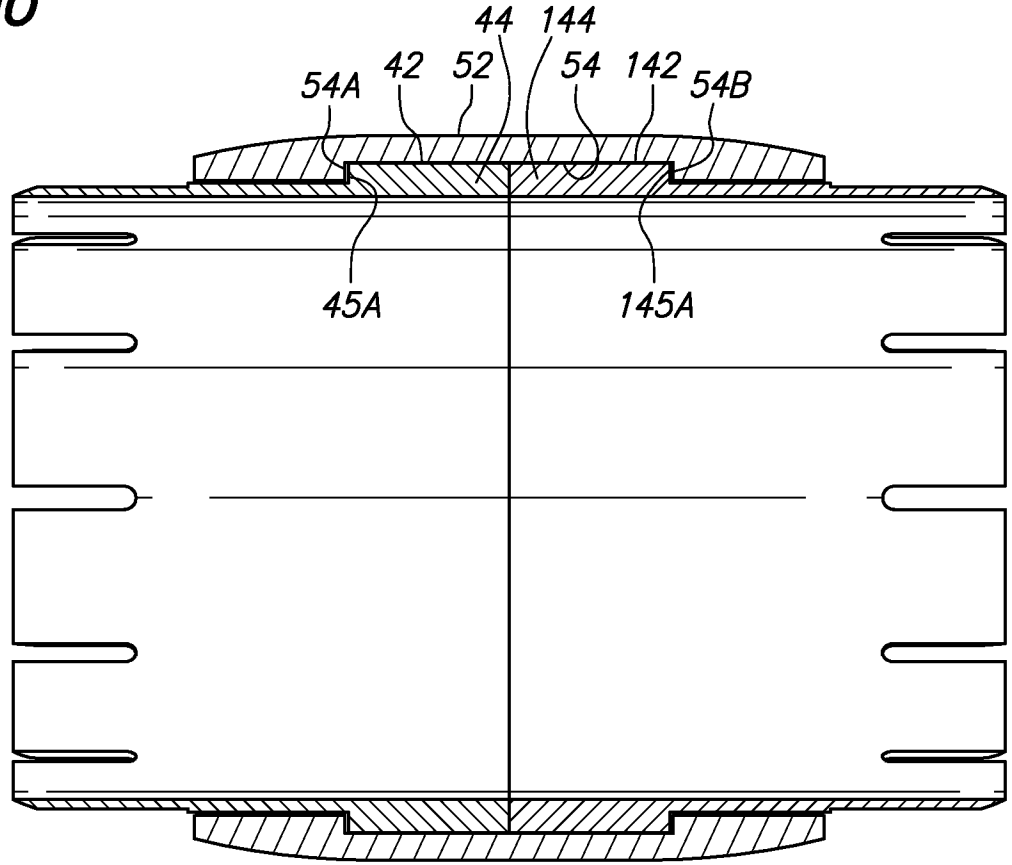
FIG. 10 is an elevation cross-section view of the rotating element of FIG. 9 with the two stop collars received within the bore of the rotating element and then allowed to expand into an interior groove in the bore of the rotating element.
Figure 11:
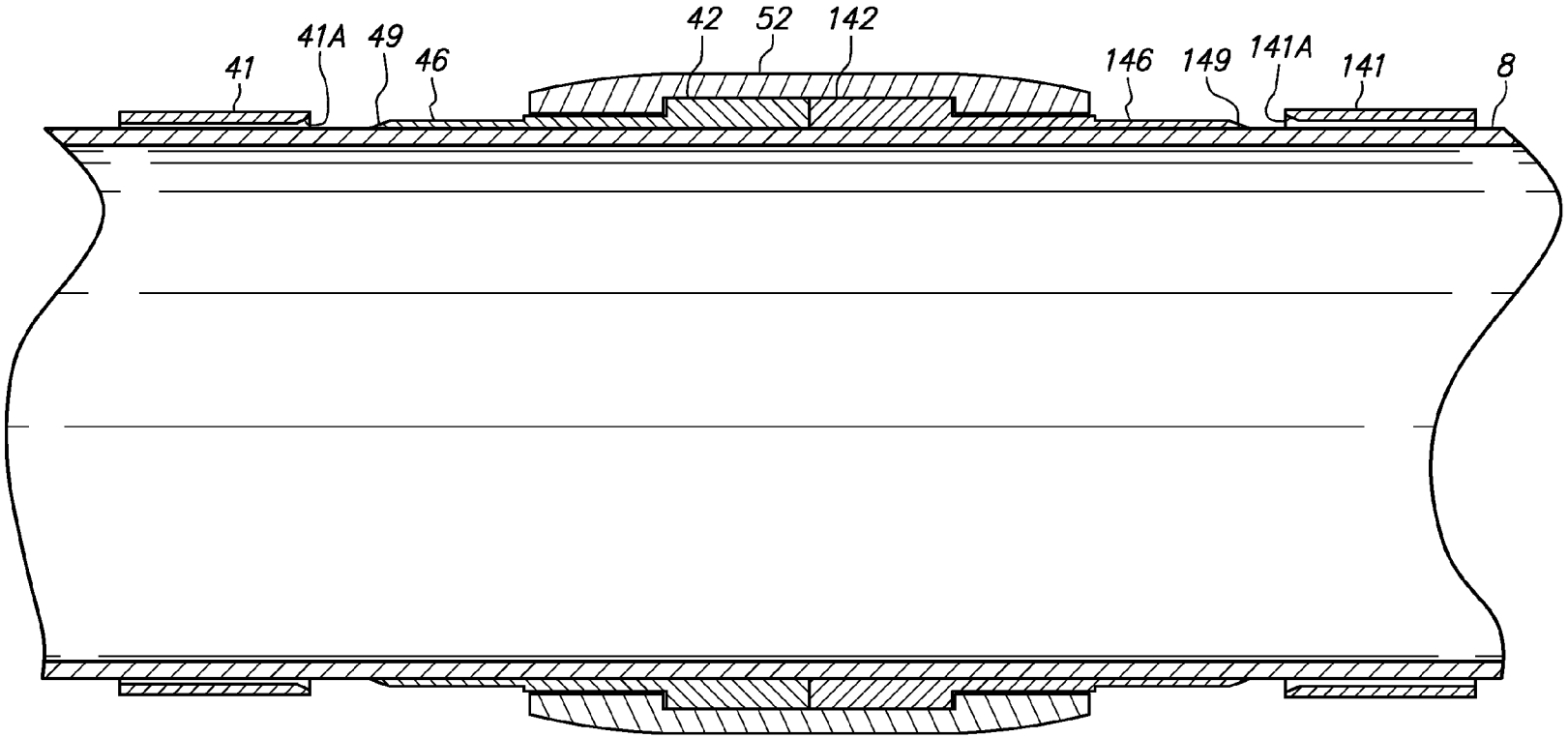
FIG. 11 is a elevation cross-section view of the rotating element and stop collars of FIG. 10 received on a tubular between two sleeves.

FIG. 8 is an alternative stop collar 42 having a widened gap 40 to accommodate elastic collapse to reduce the outer diameter to facilitate installation within a bore of a rotating element (not shown in FIG. 8—see FIGS. 9-11). The stop collar of FIG. 8 also comprises a set of fingers 46 distributed about a bore 48 and separated by slots 47, a retainer portion 44, and a spacer 43 therebetween. A first stop wall 45A is disposed intermediate the retainer portion 44 and the spacer 43 and a second stop wall 45B is disposed intermediate the spacer 43 and the fingers 46. The fingers 46 may comprise an exterior bevel 49 to facilitate installation of a sleeve (not shown in FIG. 8—see FIG. 9-11) thereon.

FIG. 9 is an elevation cross-section view of an alternative rotating element 52 with a bore 53 aligned between two stop collars 42 and 142. The stop collars 42 and 142 may include narrowed gaps (e.g., 40' and 140' in FIG. 8) to allow the stop collars 42 and 142 to be elastically collapsed to facilitate insertion into the bore 53 of the rotating element 52. The depicted rotating element 52 comprises an interior groove 54 within the bore wall 53A and between first and second groove edges 54A and 54B to receive and position the retainer portions 44 and 144 of the stop collars 42 and 142 therewithin.

FIG. 10 is an elevation cross-section view of the rotating element 52 with the retainer portions 44 and 144 of the stop collars 42 and 142 of FIG. 9 received within the bore 53 of the rotating element 52 and extending into the interior groove 54 of the rotating element 52. The retainer portions 44 and 144 of the stop collars 42 and 142 are sized to together occupy a substantial portion of the groove 54 with the first stop wall 45A of the first stop collar 42 and the second stop wall 145A of the second stop collar 142 engaging the first and second groove edges 54A and 54B to rotatably secure the rotating element 52 relative to the adjacent first and second stop collars 42 and 142. The rotating element 52 and the stop collars 42 and 142 may be slid along a tubular (not shown in FIG. 10—see FIGS. 11 and 12) to the desired installation position.

FIG. 11 is an elevation cross-section view of the rotating element 52 and stop collars 42 and 142 of FIG. 10 received onto a tubular 8 between two sleeves 41 and 141 disposed on the tubular 8 adjacent the set of fingers 46 of the first stop collar 42 and the set of fingers 146 of the second stop collar 142. The depicted sleeves 41 and 141 comprise interior bevels 41A and 141A to cooperate with exterior bevels 49 and 149 on the fingers 46 and 146 to facilitate installation of the sleeves 46 and 146 onto the fingers 46 and 146.

Figure 12:
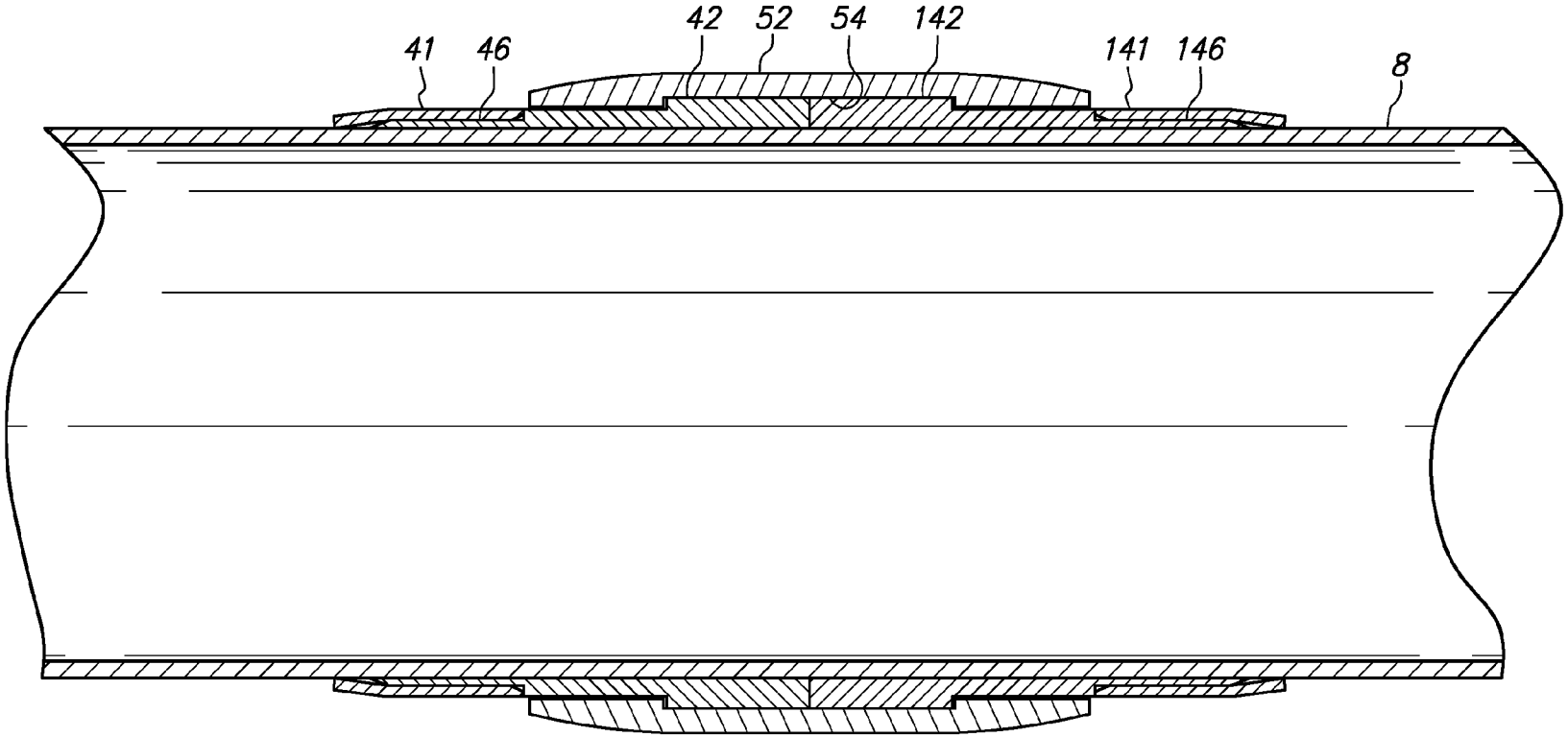
FIG. 12 is the elevation cross-section view of FIG. 11 with the two sleeves installed on the sets of fingers extending from the stop collars to secure the rotating element in a position on the tubular.

FIG. 12 is the elevation cross-section view of FIG. 11 with the sleeves 41 and 141 installed on the fingers 46 and 146 extending from stop collars 42 and 142 to secure the rotating element 52 in a position on the tubular 8 so that it will rotate relative to the stop collars 42 and 142 and the tubular 8 on which they are installed.

Figure 13:
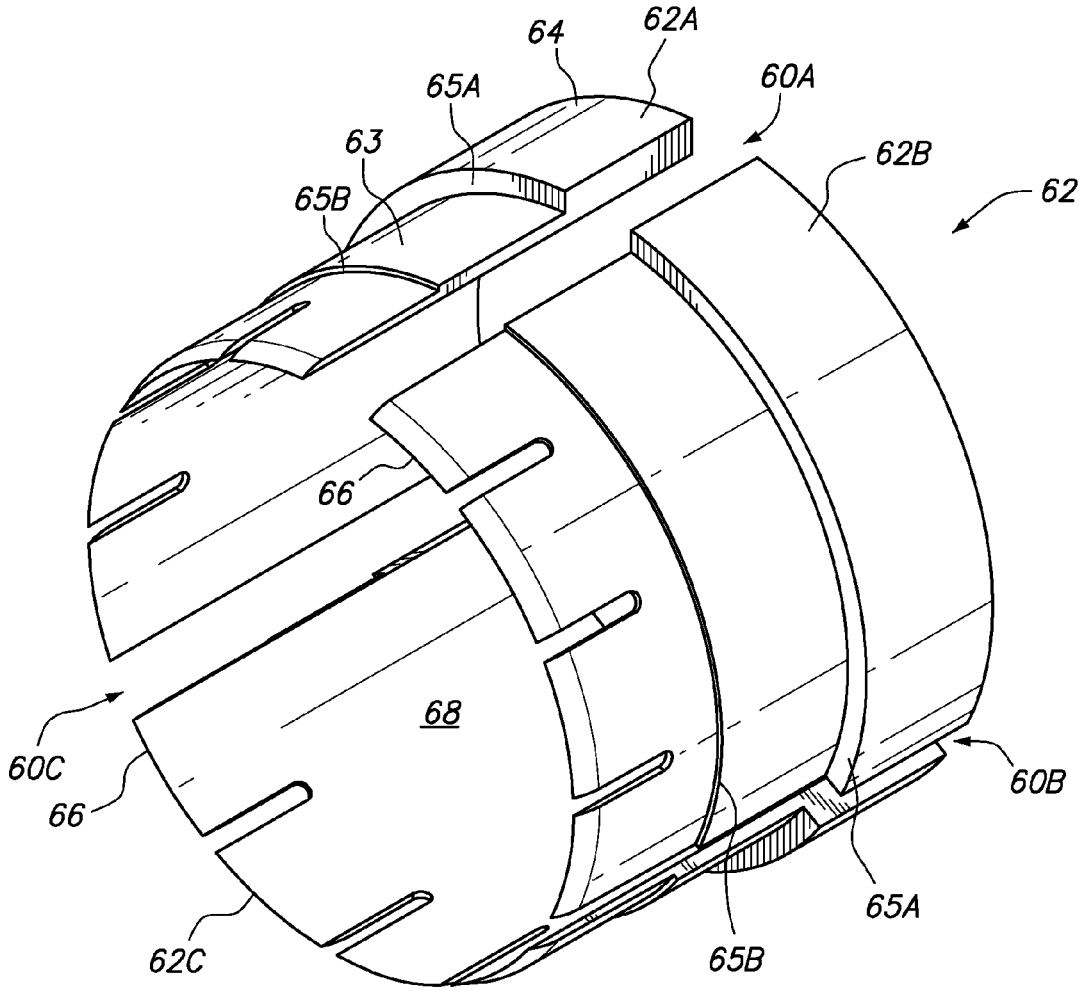
FIG. 13 is a second alternative stop collar comprising two separate portions to facilitate step-wise installation within the interior groove of the rotating element of FIGS. 9-12.

FIG. 13 is a second alternative stop collar 62 comprising three separate portions 62A, 62B and 62C to facilitate installation of the stop collar 62 within the interior groove 54 of the rotating element 52 (not shown in FIG. 13—see FIGS. 9-12). The stop collar 62 of FIG. 13 comprises a set of fingers 66, a retainer portion 64, a first stop wall 65A and a second stop wall 65B. The portions 62A, 62B and 62C are positioned in FIG. 13 one relative to the other, separated by gaps 60A, 60B and 60C, as they may be positioned when installed within the interior groove 54 of the rotating element 52 (not shown in FIG. 13—see FIGS. 9-12). Separating the stop collar 62 into portions 62A, 62B and 62C enables the stop collar 62 to be installed within the interior groove 54 one portion at a time as an alternative to the use of an elastically collapsible stop collar, as discussed in reference to FIG. 9.

Figure 14:
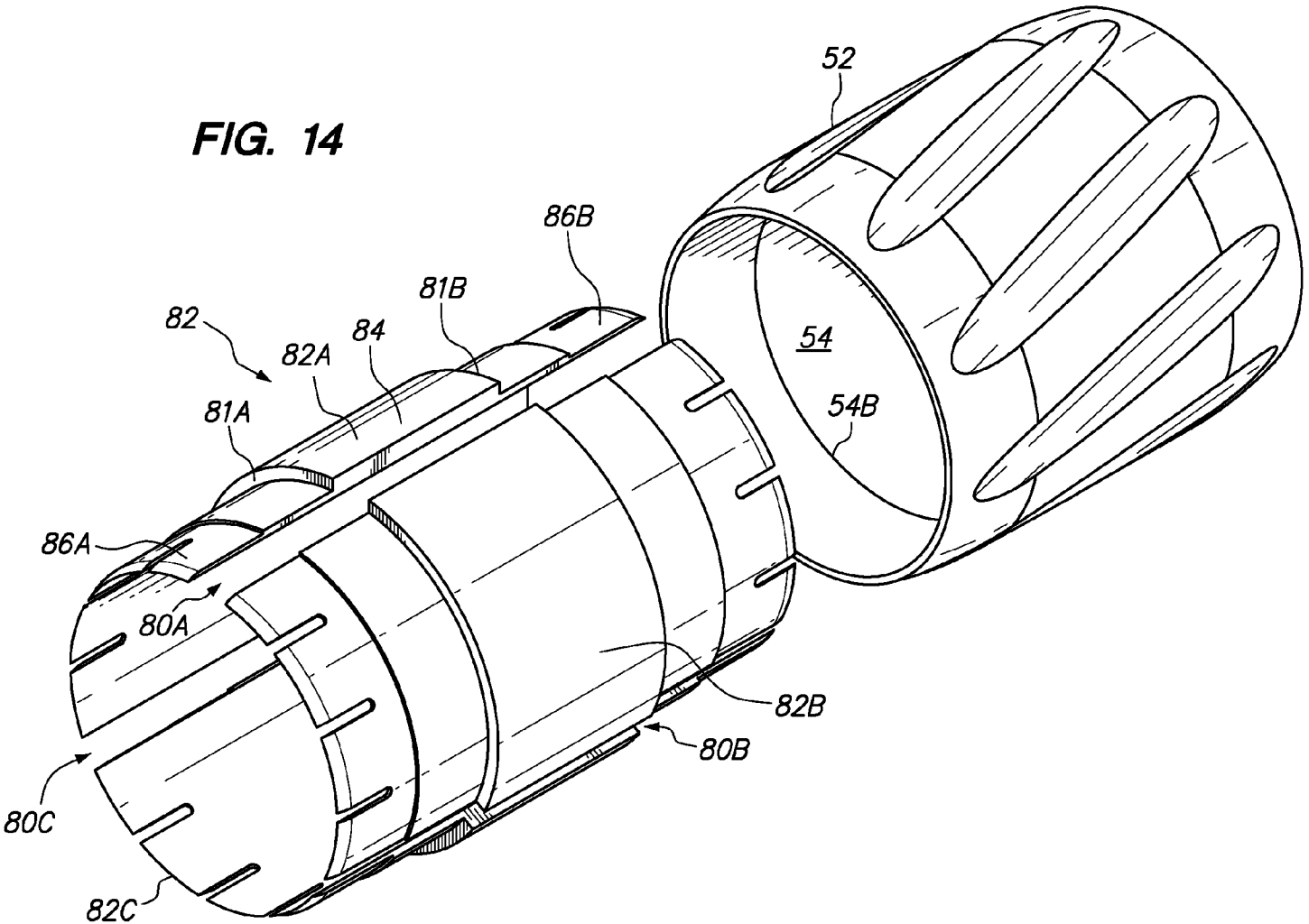
FIG. 14 is a third alternative stop collar comprising a second set of fingers, extending in a direction opposite the first set of fingers, generally aligned with the bore of a rotating element.

FIG. 14 is a third alternative stop collar 82 comprising three separate portions 82A, 82B and 82C to facilitate installation of the stop collar 82 within the interior groove 54 of the rotating element 52. The stop collar 82 comprises a retainer portion 84 and a second set of fingers 86B, extending in a direction opposite a first set of fingers 86A, and generally aligned with the bore 54 of a rotating element 52. Separating the stop collar 82 of FIG. 14 into portions 82A, 82B and 82C enables the stop collar 82 to be installed within the bore 54 of the rotating element 52 one portion at a time as an alternative to the use of an elastically collapsible stop collar. Accordingly, the retainer portion 84 of the stop collar 82 is received within the interior groove 54 as axially limited by stop walls 81A and 81B of the stop collar 82 engaging with groove edges 54A and 54B (groove edge 54A not shown in FIG. 14—see FIG. 10).

Figure 15:
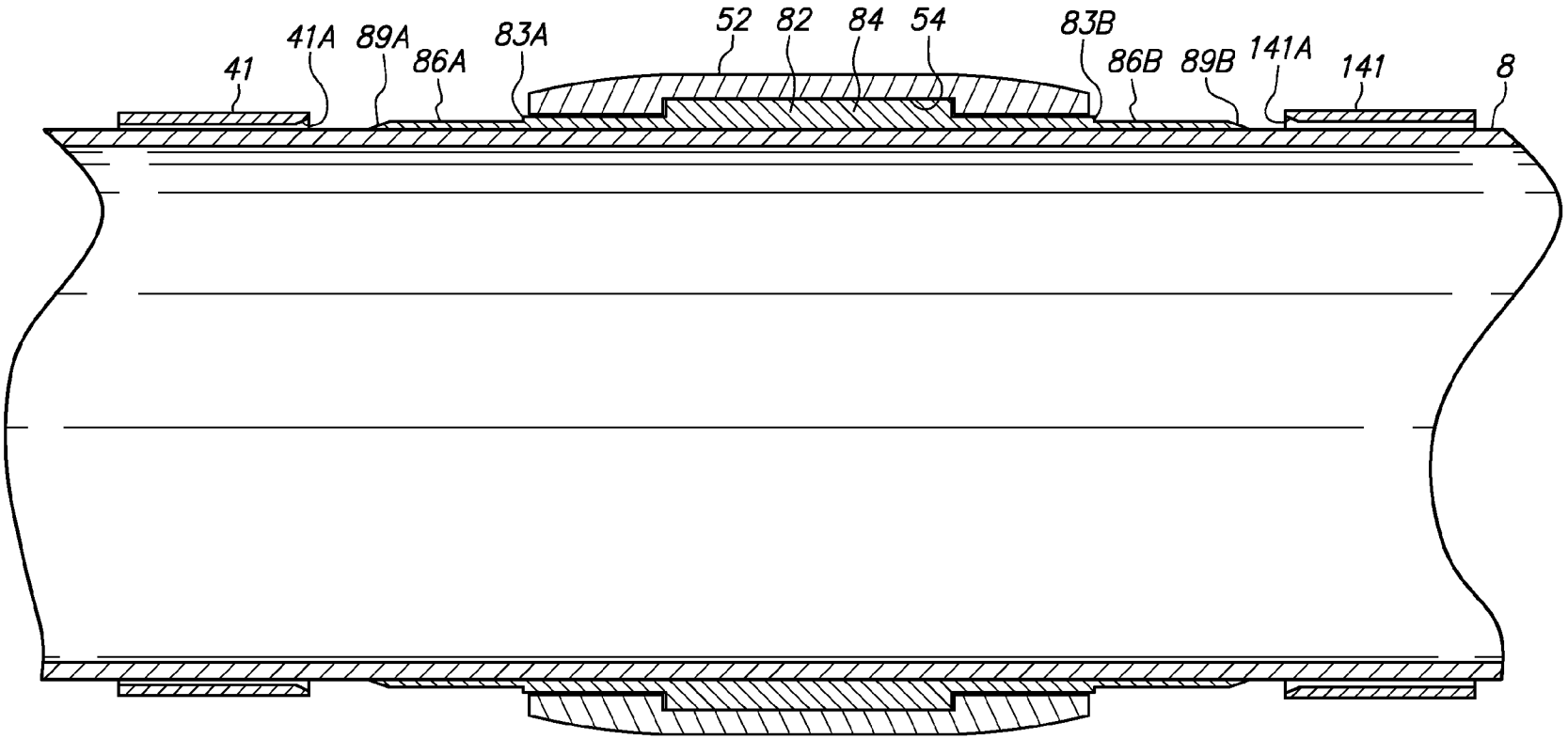
FIG. 15 is a elevation cross-section view of the stop collar of FIG. 14 received in the interior groove of the bore of the rotating element of FIG. 14 and received on a tubular between two sleeves.

FIG. 15 is a elevation cross-section view of the stop collar 82 of FIG. 14 received within the interior groove 54 of the rotating element 52 of FIG. 14 and received on a tubular 8 between two sleeves 41 and 141 disposed on the tubular 8 adjacent the first set of fingers 86A, having exterior bevels 89A, and the second set of fingers 86B, having exterior bevels 89B. The sleeves 41 and 141 comprise interior bevels 41A and 141A, respectively, to cooperate with exterior bevels 89A and 89B, respectively, to facilitate installation of the sleeves 41 and 141 onto the fingers 86A and 86B to secure the rotating element 52 in a position on the tubular 8.

Figure 16:
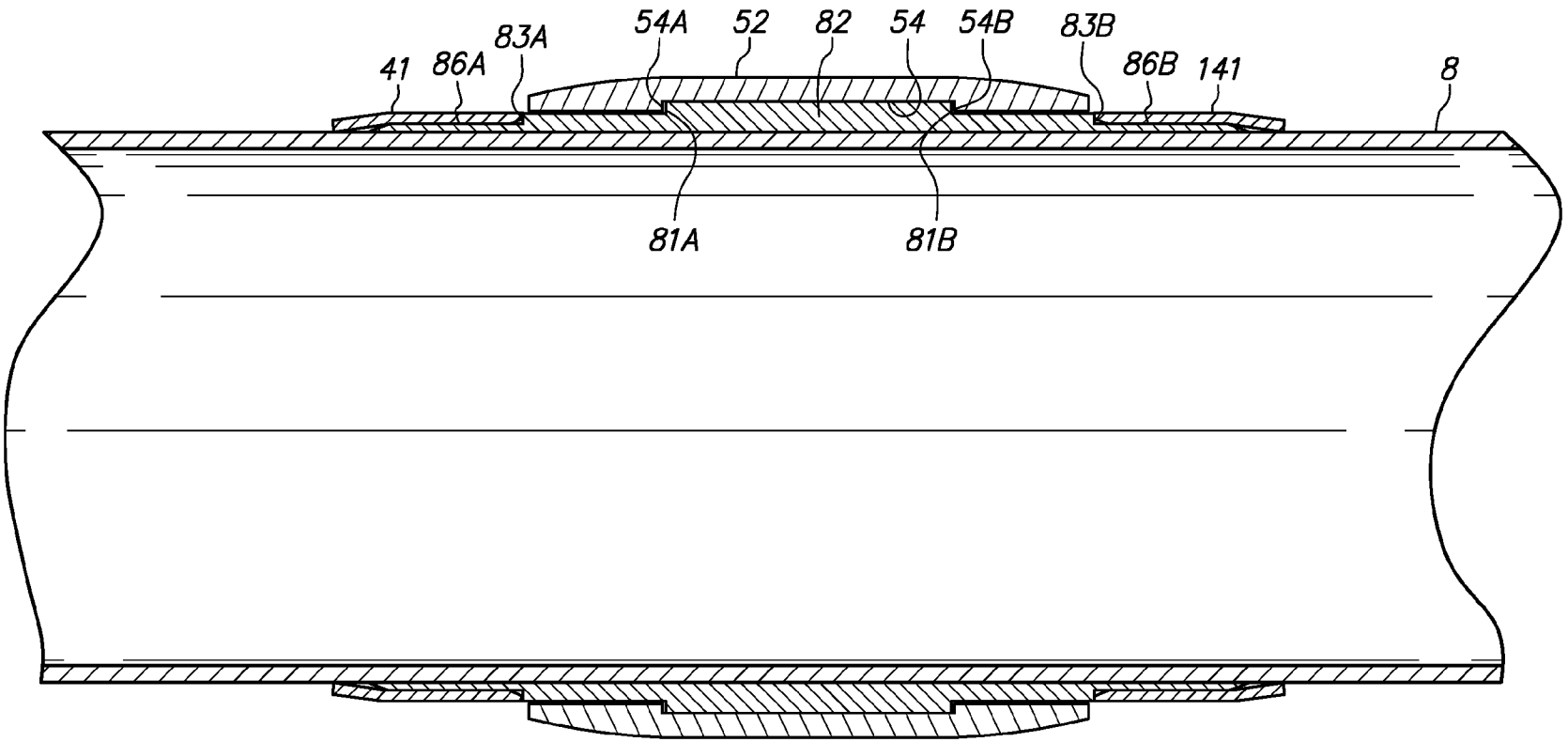
FIG. 16 is the elevation cross-section view of FIG. 15 with the sleeves installed on the fingers to secure the rotating element in a position on the tubular.

FIG. 16 is the elevation cross-section view of FIG. 15 with the sleeves 41 and 141 installed on the first and second sets of fingers 86A and 86B, respectively, to secure the stop collar 82 and to rotatably secure the rotating element 52 in a position on the tubular 8. The stop walls 81A and 81B of the stop collar 82 engage the groove edges 54A and 54B to position the rotating element 52 relative to the stop collar 82.

Figure 17:
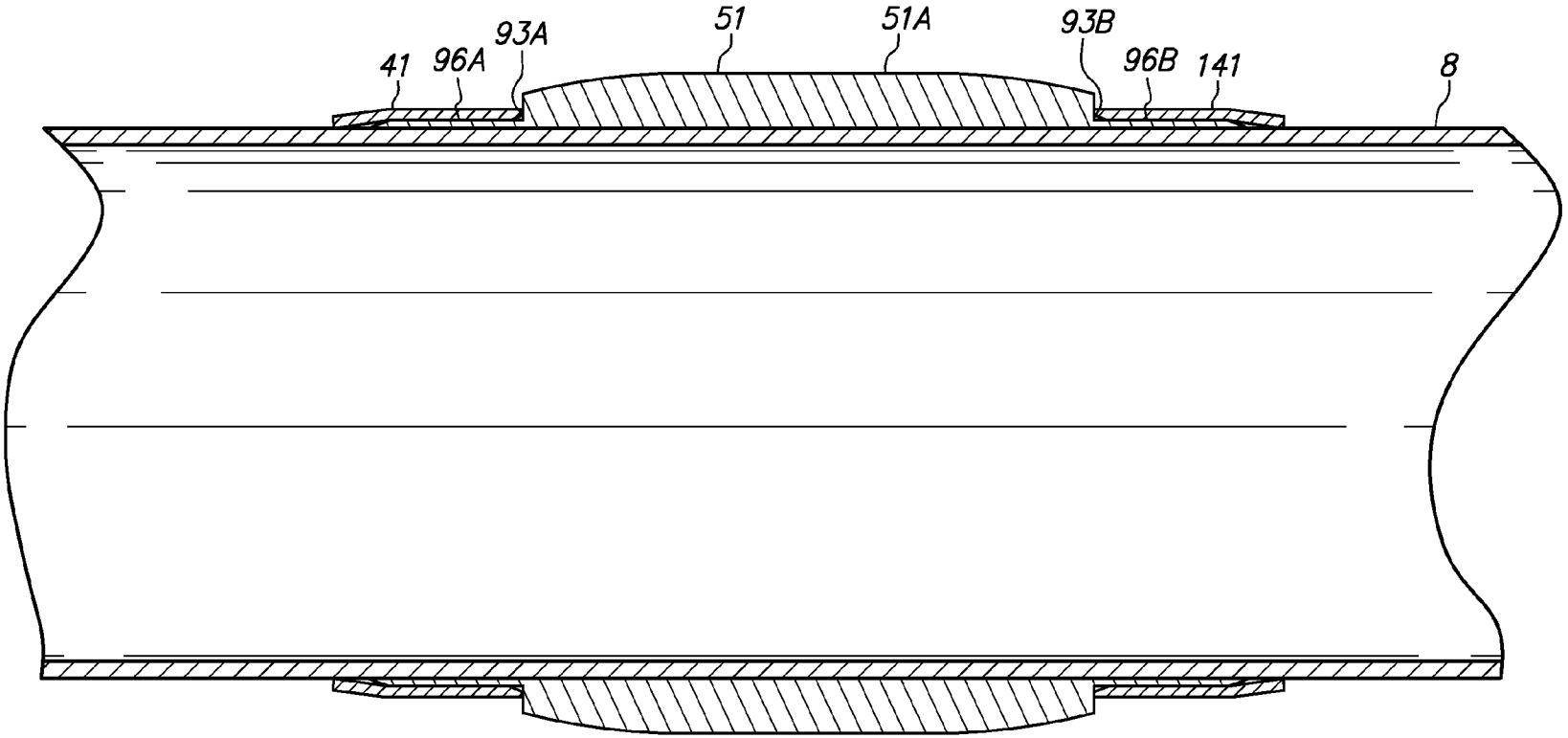
FIG. 17 is an elevation section view of a non-rotating embodiment of a wear band.

FIG. 17 is an elevation section view of an alternate embodiment of a wear band 51 installed on a tubular 8 and having no rotating element or other component that rotates relative to the tubular 8. The wear band 51 comprises a first set of fingers 96A received in an interference fit between a first sleeve 41 and the tubular 8 and a second set of fingers 93B received in an interference fit between a second sleeve 141 and the tubular 8. The wear band 51 comprises a wear surface 51A that may be coated, treated, impregnated or otherwise modified to reduce sliding friction between the wear band 51 and the wall of a borehole (not shown).

"Tubular," as that term is used herein, refers to drill pipe, casing pipe or any tubular pipe that may be used to form a tubular string that can be run into a borehole. A "stop collar," as that term is used herein, may comprise any collar, sleeve, upset portion, tubular connection or other feature disposed on a tubular string that may be used, in conjunction with an opposing stop collar, to limit or prevent the longitudinal movement of a sleeve bearing along the tubular. The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

The term "stop collar," as used herein, refers to a collar to limit the range of axial movement of a centralizer movably received on a tubular segment, and that the use of the modifier "stop" within the term "stop collar" should not be considered as limiting the use of the device to secure only stationary or fixed devices. The term "rotatably secured," as used herein, means axially secured in a manner that permits rotation of one or more components or elements, such as a rotating element, relative to the tubular to which the component or element is secured. The term "rotatably coupled," as used herein, means axially secured in a manner that permits rotation of one or more components or elements, such as a rotating element, relative to the stop collar to which the component or element is secured.

"Interior," when used to refer to a bevel, means radially inwardly disposed and "exterior," when used to refer to a bevel, means radially outwardly disposed.

U.S. Provisional Application Ser. No. 61/287,665 filed on Dec. 17, 2009, U.S. Provisional Application No. 61/237,202 filed on Aug. 26, 2009, U.S. Provisional Application No. 61/221,716 filed on Jun. 30, 2009, and U.S. Provisional Application No. 61/167,482 filed on Apr. 7, 2009, from which this application depends, are incorporated into this disclosure by reference.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

We claim:

1. A method of reducing friction between a tubular string and a bore, comprising:

receiving a first sleeve bearing having a first longitudinal end to slidably engage a first interior shoulder within a first bore portion of a rotating element;

receiving a second sleeve bearing having a first longitudinal end to slidably engage a second interior shoulder within a second bore portion of the rotating element;

receiving the rotating element and the first and second sleeve bearings onto a tubular segment;

receiving a first stop collar, having a first longitudinal end onto the tubular segment, wherein the first stop collar first longitudinal end contacts a second longitudinal end of the first sleeve bearing, preventing an external shoulder of the first stop collar from contacting a first axial end of the rotating element;

receiving a second stop collar, having a first longitudinal end onto the tubular segment opposite the first stop collar, such that the first stop collar and the second stop collar together straddle the first and second sleeve bearings, wherein the second stop collar first longitudinal end contacts a second longitudinal end of the second sleeve bearing, preventing an external shoulder of the second stop collar from contacting a second axial end of the rotating element; and securing the first and second stop collars to the tubular segment, wherein the tubular segment is rotatable relative to the rotating element and is configured to be disposed in the bore as part of the tubular string.

2. The method of claim 1, further comprising:

rotating the tubular segment relative to the rotating element.

3. The method of claim 1, wherein the rotating element further comprises a radially inwardly protruding shoulder intermediate the first bore portion and the second bore portion.

4. The method of claim 3, further comprising disposing the first and second sleeve bearings proximate the radially inwardly protruding shoulder of the rotating element.

5. An apparatus to reduce friction between a tubular segment and a bore, comprising:

a rotating element defining a first bore portion and a second bore portion, the first and second bore portions received onto the tubular segment;

a first sleeve bearing having an outer surface slidably contacting the first bore portion and an inner surface slidably contacting the tubular segment;

a second sleeve bearing having an outer surface slidably contacting the second bore portion and an inner surface slidably contacting the tubular segment; and a first stop collar received on the tubular segment having a first longitudinal end contacting a second longitudinal end of the first sleeve bearing such that the first sleeve bearing prevents an external shoulder of the first stop collar from directly contacting a first axial end of the rotating element, wherein the rotating element is rotatable relative to the tubular segment at least while the first and second bore portions thereof are received on the tubular segment.

6. The apparatus of claim 5 further comprising:

a second stop collar received on the tubular segment and comprising a bearing face contacting the second sleeve bearing such that the second sleeve bearing prevents the bearing face of the second stop collar from directly contacting a second axial end of the rotating element.

7. The apparatus of claim 6, wherein the first and second stop collars are secured to the tubular segment to together straddle the first and second sleeve bearings.

8. The apparatus of claim 5, wherein the rotating element further comprises an inwardly protruding shoulder intermediate the first bore portion and the second bore portion.

9. The apparatus of claim 5, wherein the rotating element further comprises an outer surface having a plurality of fluid channels therein to facilitate fluid flow within an annulus around the outer surface.

10. The apparatus of claim 5, wherein the first stop collar is rotationally fixed to the tubular segment, and the rotating element is rotatable relative to the first stop collar.

11. An apparatus to reduce frictional resistance to rotation of a tubular string within a bore comprising:

a rotating element received onto a tubular segment coupled into the tubular string, the rotating element being rotatable with respect to the tubular segment while received thereon;

a first stop collar received on the tubular segment, the first stop collar having a first longitudinal end disposed towards the rotating element;

a second stop collar received on the tubular segment, the second stop collar having a first longitudinal end disposed towards the rotating element and the first stop collar; and a first sleeve bearing received on the tubular segment axially intermediate the first stop collar and at least a portion of the rotating element, and radially intermediate the rotating element and the tubular segment, the first sleeve bearing having a first longitudinal end that bears on the first longitudinal end of the first stop collar so as to prevent an external shoulder of the first stop collar from contacting an axial end of the rotating element.

12. The apparatus of claim 11, further comprising:

an inwardly protruding shoulder with a first bearing face and a second bearing face on the rotating element separating a first bore portion and a second bore portion of the rotating element; and a second sleeve bearing received on the tubular segment axially intermediate the first sleeve bearing and the second stop collar and radially intermediate the second bore portion of the rotating element and the tubular segment, the second sleeve bearing being configured to bear on the first longitudinal end of the second stop collar so as to prevent the first longitudinal end of the second stop collar from contacting an axial end of the rotating element, wherein the first sleeve bearing is axially intermediate the second sleeve bearing and the first stop collar, and radially intermediate the first bore portion and the tubular segment.

13. The apparatus of claim 12, wherein the first longitudinal end of the first stop collar limits an axial range of movement of the first sleeve bearing, and the first longitudinal end of the second stop collar limits an axial range of movement of the second sleeve bearing.

14. The apparatus of claim 12, wherein the first sleeve bearing and the second sleeve bearing together limit an axial range of movement and a radial range of movement of the rotating element.

* * * * *